US009033457B2

(12) United States Patent
Oikawa et al.

(10) Patent No.: US 9,033,457 B2
(45) Date of Patent: May 19, 2015

(54) PRINT HEAD AND INK JET PRINTING APPARATUS

(71) Applicant: CANON KABUSHIKI KAISHA, Tokyo (JP)

(72) Inventors: Satoshi Oikawa, Yokohama (JP); Yuji Tamaru, Yokohama (JP); Yukuo Yamaguchi, Tokyo (JP); Satoshi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/866,478

(22) Filed: Apr. 19, 2013

(65) Prior Publication Data

US 2014/0022309 A1 Jan. 23, 2014

(30) Foreign Application Priority Data

Apr. 26, 2012 (JP) ..... 2012-101330

(51) Int. Cl.
*B41J 2/015* (2006.01)
*B41J 2/14* (2006.01)
*B41J 2/15* (2006.01)

(52) U.S. Cl.
CPC ..... *B41J 2/1433* (2013.01); *B41J 2/14072* (2013.01); *B41J 2/15* (2013.01)

(58) Field of Classification Search
None
See application file for complete search history.

(56) References Cited

U.S. PATENT DOCUMENTS

| | | | | |
|---|---|---|---|---|
| 6,824,243 | B2 | 11/2004 | Yamaguchi et al. | |
| 6,913,351 | B2 | 7/2005 | Yamaguchi et al. | |
| 8,342,659 | B2 | 1/2013 | Fujii et al. | |
| 2005/0128548 | A1 * | 6/2005 | Kashino et al. | 359/205 |
| 2010/0283819 | A1 | 11/2010 | Tamaru et al. | |

FOREIGN PATENT DOCUMENTS

JP 2009-298031 A 12/2009

* cited by examiner

*Primary Examiner* — Matthew Luu
*Assistant Examiner* — Erica Lin
(74) *Attorney, Agent, or Firm* — Fitzpatrick, Cella, Harper & Scinto

(57) ABSTRACT

A print head and an ink jet printing apparatus are provided which can have smaller sizes if a print head is used which includes a substrate with a plurality of ejection port arrays and a substrate with ejection port arrays longer than the plurality of ejection port arrays. A drive circuit formed in a substrate is formed outside ejection port arrays in the substrate along the extending direction of the ejection port arrays. The drive circuit formed on an overlapping side of the substrate where the ejection port arrays overlap is formed to be longer, along the extending direction of the ejection port arrays, than a drive circuit formed on a side of the substrate which is opposite to the overlapping side. Furthermore, the ejection port arrays of the substrates overlap in the extending direction of ink supply ports, and the substrates are mounted on a support.

9 Claims, 6 Drawing Sheets

PRINT HEAD AND INK JET PRINTING APPARATUS

BACKGROUND OF THE INVENTION

1. Field of the Invention

The present invention relates to a print head that ejects ink for printing and an ink jet printing apparatus including the print head.

2. Description of the Related Art

In recent years, there has been a demand to further increase the operating speed of ink jet printing apparatuses. For ink jet printing apparatuses of a serial scan type which perform printing while allowing a print head to scan print medium in a width direction thereof, there has also been a demand to increase the printing speed. A typical measure for increasing the printing speed of the print head is to elongate ejection port arrays in the print head. Some print heads are elongated by connecting a plurality of substrates with ejection port arrays formed therein together in a direction in which the ejection port arrays are formed. This increases the print length that can be printed during a single scan. Thus, the number of scans required can be reduced, enabling efficient printing. However, if the print head is elongated by connecting a plurality of substrates with ejection port arrays formed therein together, the print head may have an increased size. Thus, a print head disclosed in Japanese Patent Laid-Open No. 2009-298031 has been proposed. According to Japanese Patent Laid-Open No. 2009-298031, two substrates are connected together along an extending direction of ejection port arrays. The two substrates are misaligned with each other in a direction intersecting the extending direction of the ejection port arrays. The substrates are arranged so as to partly overlap along the extending direction of the ejection port arrays. In each of the substrates connected together, ejection ports and ink supply ports are eccentrically located outward of the ejection port arrays in the extending direction thereof. Thus, a drive section for driving print elements can be arranged in an area where the substrates overlap. This enables a reduction in the length along the extending direction of the ejection port arrays in the print head, allowing the print head to be miniaturized.

As a single-color print head that ejects only ink in one color, the print head disclosed in Japanese Patent Laid-Open No. 2009-298031 may be used. However, for color printing, a print head may be used which includes both a substrate with a plurality of ejection port arrays associated with the color printing and a substrate with ejection port arrays that eject black ink. In such a case, the print head cannot be sufficiently miniaturized and may have an increased size.

SUMMARY OF THE INVENTION

Thus, in view of the above-described circumferences, it is an object of the present invention to provide a print head and an ink jet printing apparatus which can have smaller sizes if a print head is used which includes a substrate with a plurality of ejection port arrays and a substrate with ejection port arrays longer than the plurality of ejection port arrays.

According to the present invention, a print head which is mountable in an ink jet printing apparatus and which ejects ink for printing, the print head comprising: a substrate comprising a plurality of ejection ports through which ink is ejected, print elements arranged in ink channels that are in communication with the respective ejection ports, each of the print elements being driven to apply kinetic energy to the ink in the corresponding ink channel to eject the ink through the corresponding ejection port, a drive circuit for driving the print elements, and an ink supply port that supplies ink to the ink channels, and a support that supports the substrate, wherein the substrate includes: a first substrate comprising a plurality of first ink supply ports formed therein and extending parallel to one another and first ejection port arrays formed therein and each first ejection port array comprising the ejection ports arranged along each of the plurality of first ink supply port in a first direction in which the first ink supply port extends; and a second substrate comprising a second ink supply port formed therein and extending parallel to the first direction and arranged outward of the first substrate along a second direction orthogonal to the first direction, the second ink supply port being longer than the first ink supply port, a number of the second ink supply ports being smaller than a number of the first ink supply ports, and second ejection port arrays formed in the second substrate and comprising the ejection ports arranged in the first direction along the second ink supply port, the second ejection port arrays being formed to be longer than the first ejection port arrays along the first direction, the drive circuit formed in the second substrate is formed outside the second ejection port arrays in the second substrate along the first direction, and the drive circuit formed on an overlapping side of the second substrate where the first ejection port arrays and the second ejection port arrays overlap is formed to be longer, along the first direction, than the drive circuit formed on a side of the second substrate opposite to the overlapping side, and the first ejection port arrays and the second ejection port arrays overlap in an extending direction of the first ink supply ports and the second ink supply port, and the first substrate and the second substrate are mounted on a support.

According to the present invention, an ink jet printing apparatus with a print head that ejects ink for printing, wherein the print head comprises a substrate comprising a plurality of ejection ports through which ink is ejected, print elements arranged in ink channels that are in communication with the respective ejection ports, each of the print elements being driven to apply kinetic energy to the ink in the corresponding ink channel to eject the ink through the corresponding ejection port, a drive circuit for driving the print elements, and an ink supply port that supplies ink to the ink channels, and a support that supports the substrate, the substrate includes: a first substrate comprising a plurality of first ink supply ports formed therein and extending parallel to one another and first ejection port arrays formed therein and each first ejection port array comprising the ejection ports arranged along each of the plurality of first ink supply port in a first direction in which the first ink supply port extends; and a second substrate comprising a second ink supply port formed therein and extending parallel to the first direction and located outward of the first substrate along a second direction orthogonal to the first direction, the second ink supply port being longer than the first ink supply port, a number of the second ink supply ports being smaller than a number of the first ink supply ports, and second ejection port arrays formed in the second substrate and comprising the ejection ports arranged in the first direction along the second ink supply port, the second ejection port arrays being formed to be longer than the first ejection port arrays along the first direction, the drive circuit formed in the second substrate is formed outside the second ejection port arrays in the second substrate along the first direction, and the drive circuit formed on an overlapping side of the second substrate where the first ejection port arrays and the second ejection port arrays overlap is formed to be longer, along the first direction, than the drive circuit formed on a side of the second substrate opposite to the overlapping side, and the first ejection port arrays and the second ejection port arrays overlap in an extending direction of the first ink supply ports and the second ink supply port, and the first substrate and the second substrate are mounted on a support.

According to the present invention, an ink jet printing apparatus with a first print head and a second print head which eject ink for printing, wherein each of the first print head and the second print head comprises a substrate comprising a plurality of ejection ports through which ink is ejected, print elements arranged in ink channels that are in communication with the respective ejection ports, each of the print elements being driven to apply kinetic energy to the ink in the corresponding ink channel to eject the ink through the corresponding ejection port, a drive circuit for driving the print elements, and an ink supply port that supplies ink to the ink channels, and a support that supports the substrate, the first print head comprises a first substrate mounted therein and comprising a plurality of first ink supply ports formed in the first substrate and extending parallel to one another and first ejection port arrays formed in the first substrate and each first ejection port array comprising the ejection ports arranged along each of the plurality of first ink supply port in a first direction in which the first ink supply port extends, the second print head comprises a second substrate mounted therein and comprising a second ink supply port formed in the second substrate and extending parallel to the first direction, the second ink supply port being longer than the first ink supply port, a number of the second ink supply ports being smaller than a number of the first ink supply ports, and second ejection port arrays formed in the second substrate and comprising the ejection ports arranged in the first direction along the second ink supply port, the second ejection port arrays being formed to be longer than the first ejection port arrays along the first direction, the drive circuit formed in the second substrate is formed outside the second ejection port arrays in the second substrate along the first direction, and the drive circuit formed on an overlapping side of the second substrate where the first ejection port arrays and the second ejection port arrays overlap is formed to be longer, along the first direction, than the drive circuit formed on a side of the second substrate opposite to the overlapping side, and the first ejection port arrays and the second ejection port arrays overlap in an extending direction of the first ink supply ports and the second ink supply port, and the first print head and the second print head are mounted on a support.

The present invention can miniaturize the print head and thus the ink jet printing apparatus with the print head mounted therein. Thus, an ink jet printing apparatus can be provided which saves required space and which is easy-to-use. Furthermore, the manufacturing costs of the print head and the ink jet printing apparatus can be restrained from increasing.

Further features of the present invention will become apparent from the following description of exemplary embodiments (with reference to the attached drawings).

DESCRIPTION OF THE EMBODIMENTS

Embodiments of the present invention will be described below with reference to the attached drawings.

First Embodiment

Figure 1:
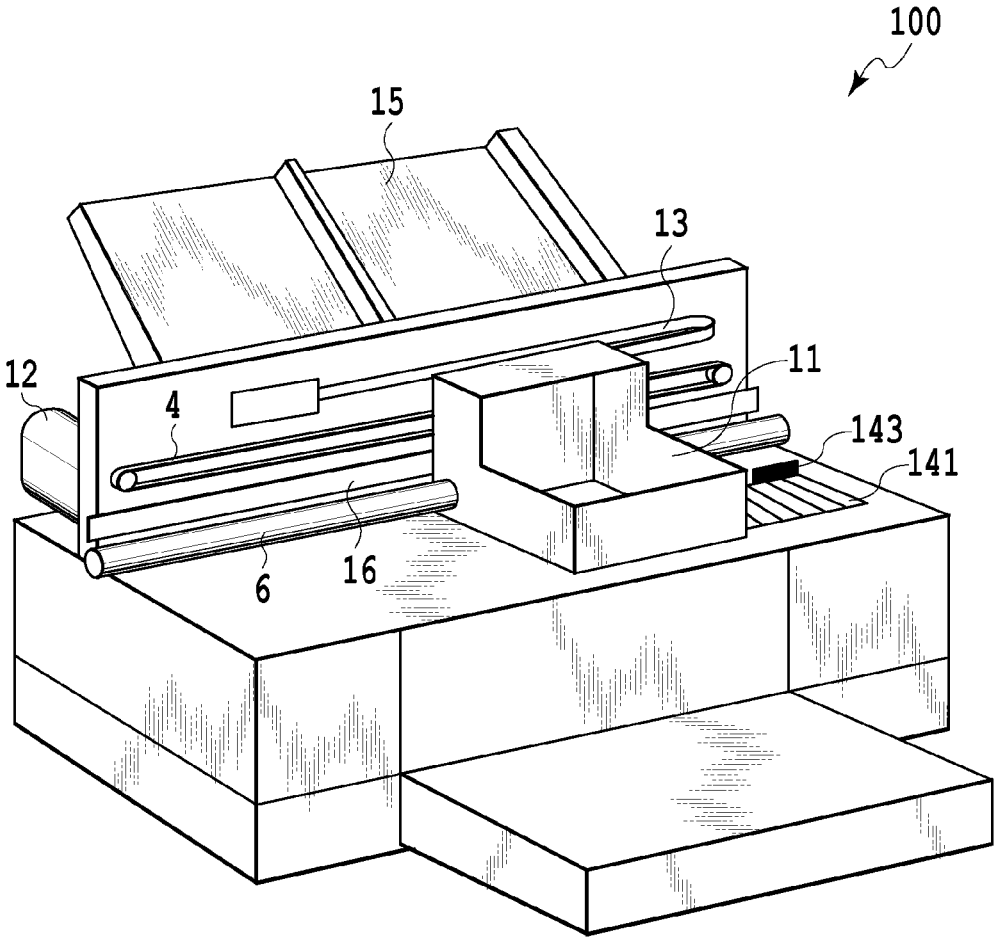
FIG. 1 is a perspective view of an ink jet printing apparatus with a print head according to a first embodiment of the present invention mounted therein.

First, an ink jet printing apparatus according to a first embodiment of the present invention will be described. FIG. 1 is a perspective view showing the appearance of an ink jet printing apparatus 100 according to the first embodiment. The ink jet printing apparatus 100 shown in FIG. 1 includes a carriage 11 that can store a print head 1. The carriage 11 scans a print medium in a predetermined direction intersecting a conveying direction of the print medium, particularly a direction orthogonal to the conveying direction according to the present embodiment. Thus, the print head performs printing while scanning the print medium in the predetermined direction intersecting the conveying direction in which the print medium is conveyed. As described above, the ink jet printing apparatus 100 is a serial scan type printing apparatus that prints an image by moving the print head 1 in a main scan direction and conveying the print medium in a sub-scan direction. The direction of scanning according to the preset embodiment is hereinafter referred to as the main scan direction.

The carriage 11 is penetrated and supported by a guide shaft 6 so as to perform scanning in the direction orthogonal to the conveying direction of the print medium. A belt 4 is attached to the carriage 11, and a carriage motor 12 is attached to the belt 4. Thus, a drive force exerted by the carriage motor 12 is transmitted to the carriage 11 via the belt 4. Hence, the carriage 11 is configured to be movable in the main scan direction, in which the carriage 11 is guided by the guide shaft 6.

Furthermore, a flexible cable 13 is attached to the carriage 11 so as to be connected to a head cartridge 50 so that electric signals from a control section described below are transferred to the print head in the head cartridge 50 through the flexible cable 13. The printing apparatus 100 includes a cap 141 and a wiper blade 143 arranged therein and used for a process of recovering the print head. The ink jet printing apparatus 100 also has a sheet feeding section 15 in which print media are stored in a stacked manner and an encoder sensor 16 that optically reads the position of the carriage 11.

Figure 2:
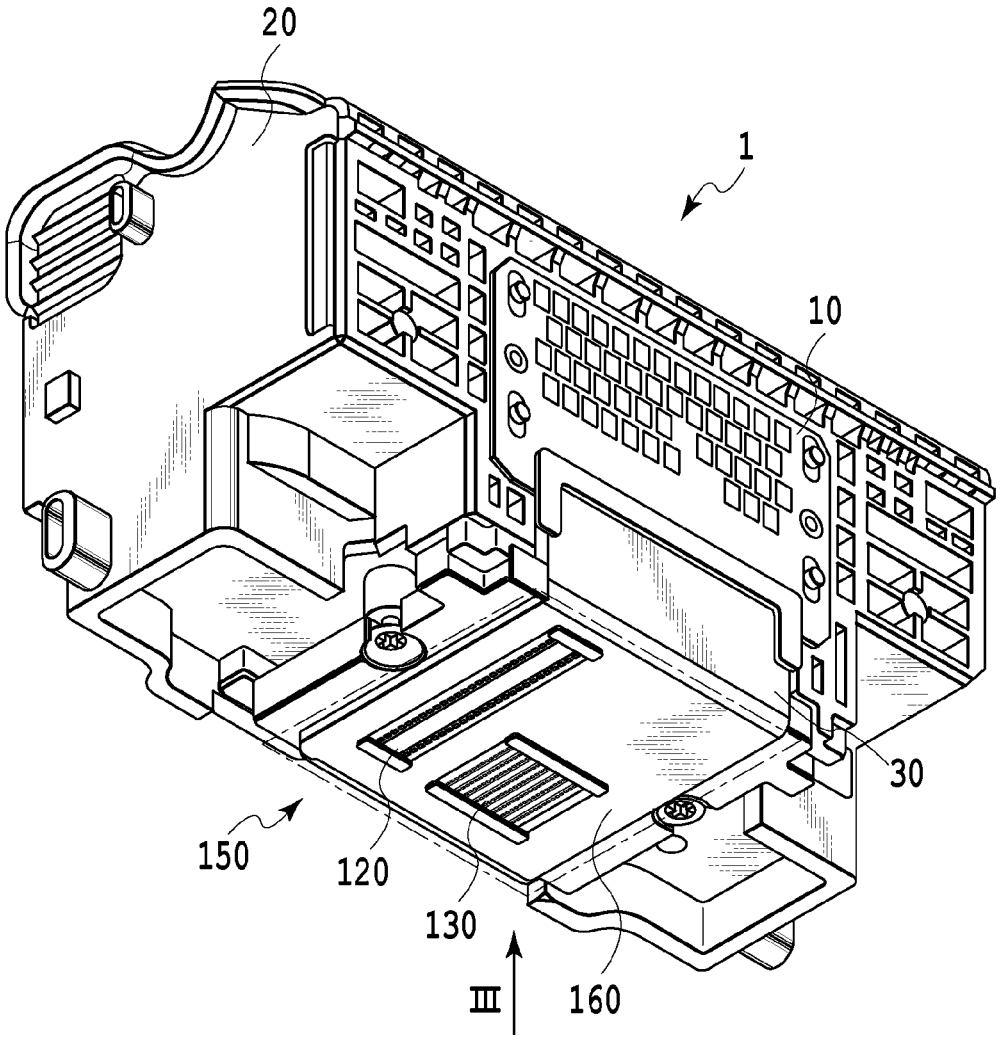
FIG. 2 is a perspective view of the print head mounted in the ink jet printing apparatus in FIG. 1.

FIG. 2 shows a perspective view of the print head 1 according to the first embodiment. The print head 1 includes substrates 120 and 130 mounted on a surface thereof which lies opposite the print medium. The print head 1 has a support 160 on which the substrates 120 and 130 are mounted. The substrates 120 and 130 are mounted on the support 160, which supports the substrates 120 and 130. Furthermore, a contact substrate 10 is provided in an area where the print head 1 and the carriage 11 come into contact with each other when the print head 1 is installed on the carriage 11. A signal for allowing ink to be ejected and power required to eject ink are fed from the ink jet printing apparatus 100 to the print head 1 via the contact substrate 10. The signal and power fed to the contact substrate 10 are fed to the substrates 120 and 130 via a wiring member 30.

The substrates 120 and 130 include a plurality of ejection ports through which ink is ejected. Ink channels communicated with the ejection ports are formed in the substrates 120 and 130 and each include a print element arranged therein and serving as an energy generating element that generates energy required to eject ink. The print element is driven when supplied with power to apply kinetic energy to the ink in the ink channel to eject the ink through the ejection port. The present embodiment includes heat generating elements (electrothermal transducing elements) as the print elements. Furthermore, the substrates 120 and 130 include drive circuits 124 and 134, respectively, formed thereon to drive the heat generating elements. The signal for allowing ink to be ejected and the power required to eject ink are fed to each of the heat generating elements via the drive circuits 124 and 134 formed on the substrates 120 and 130, respectively. Additionally, the substrates 120 and 130 include ink supply ports 122 and 132, respectively, formed therein to feed ink to the ink channels inside the substrates 120 and 130, which are in communication with the respective ejection ports. Ink fed from an ink tank (not shown in the drawings) is fed through the ink supply ports 122 and 132 to the ink channels, which are in communication with the respective ejection ports. According to the present embodiment, the ejection ports formed in the substrates 120 and 130 are arranged along the ink supply ports 122 and 132 to form ejection port arrays 121 and 131, respectively. The ejection port arrays 121 are formed on both sides of the ink supply port 122. The ejection port arrays 131 are formed on both sides of each of the ink supply ports 132. The ink supply ports 122 and 132 and the ejection port arrays 121 and 131 are arranged so that the ink supply port 122 is sandwiched between the ejection port arrays 121 and that each of the ink supply ports 132 is sandwiched between the ejection port arrays 131.

The substrate 120 ejects black ink, mainly used to print characters. The substrate 130 ejects color ink, mainly used to print photographs, figures, and the like.

Furthermore, the substrates 120 and 130 include contact pads 123 and 133, respectively, for electrically connecting the substrates 120 and 130 to wiring substrates, and drive circuits 124 and 134, respectively, having a shift register that drives the heat generating elements, a latch circuit, a decoder, and the like. The substrate 120 and 130 also includes wiring 135 that connects the drive circuit 124 and 134 to each of the energy generating elements (see FIG. 4A).

Ink is contained in ink tanks for respective colors (not shown in the drawings) which are removable from the print head 1. The ink tanks for the respective colors are set in a holder member 20. The ink containers set in the holder member 20 are in communication with ink channels in the holder member 20 to feed the ink to an ejection unit 150 on which the ejection substrates 120 and 130 are supported.

The ink stored in the ink channels inside the ejection unit 150 in the print head 1 is stably held by forming meniscus at the ejection ports, arranged at tips of the ink channels. According to the present embodiment, the heat generating elements serving as the print elements are energized and driven to allow the heat generating elements to generate thermal energy. Then, the ink in the ink channels is heated to cause film boiling therein and is thus bubbled, with the resultant bubbling energy allowing ink droplets to be ejected through the ejection ports. Thus, the print head 1, mounted in the ink jet printing apparatus 100, performs printing by ejecting the ink through the ejection ports, formed in the ejection substrates 120 and 130, in accordance with an ejection signal from the ink jet printing apparatus 100. The print medium is inserted into the ink jet printing apparatus 100 and then conveyed in the sub-scan direction by a conveying roller. The ink jet printing apparatus 100 repeats a printing operation of ejecting ink toward a predetermined print area of the print medium on a platen while moving the print head 1 in the main scan direction and a conveying operation of conveying the print medium in the sub-scan direction by a distance corresponding to a print width subjected to the printing. Thus, images are sequentially printed on the print medium.

As described above, the print head 1 is configured such that the heat generating elements of the print head 1 causes film boiling in the ink to bubble the ink, thus allowing ink droplets to be ejected. However, the present invention is not limited to this. Piezoelectric elements may be modified to allow a print head configured to eject a liquid inside the print head to be applied to the printing apparatus. Furthermore, another form of print head may be applied to the printing apparatus according to the present invention.

Figure 3:
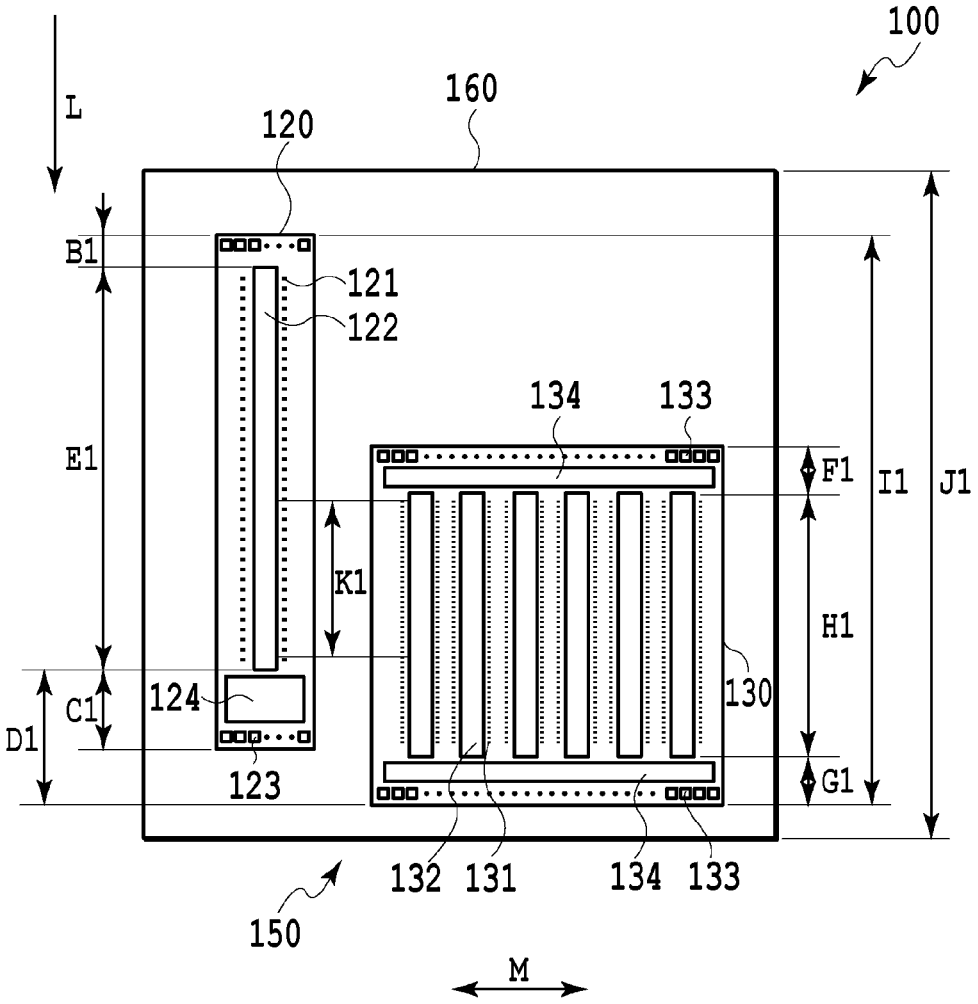
FIG. 3 is a plan view showing the print head in FIG. 2 as viewed in the direction of arrow III in FIG. 2.

FIG. 3 is a plan view of an area enclosed by a dashed line in FIG. 2 and which corresponds to a surface opposite to the print medium, as viewed in the direction of arrow III in FIG. 2. FIG. 3 shows the ejection unit 150 in the print head 1 according to the present embodiment.

The substrate 120 (second substrate), which ejects black ink, has one ink supply port 122 and corresponding ejection port arrays (second ejection port arrays) 121. According to the present embodiment, the ink supply port 122 in the substrate 120 has a length E1 of 0.85 inches along an extending direction of the ejection port arrays. In this manner, according to the present embodiment, the substrate 120 includes a single ink supply port (second ink supply port) 122 formed therein. The substrate 120 is arranged so as to extend parallel to the extending direction of the ejection port arrays 121 and the ink supply port 122. The substrate 120 has the ink supply port 122 that is longer than the ink supply ports 131 in the substrate 130. The number of ink supply ports 122 is smaller than the number of ink supply ports 132 formed in the substrate 130. Furthermore, the ejection ports are arranged along the ink supply port 122 along the extending direction of the ink supply port 122. The ejection port arrays 121, which are longer than the ejection port arrays 131 in the substrate 130, are formed along the extending direction of the ink supply port 122. According to the present embodiment, the substrate 120 is formed to be relatively long in the extending direction of the ejection port arrays 121, in order to allow characters to be printed faster.

Furthermore, the substrate 130 (first substrate) ejects ink in a plurality of colors. The substrate 130 ejects ink in a plurality of colors such as Y (yellow), M (magenta), and C (cyan), and thus the plurality of ink supply ports (first ink supply ports) 132 corresponding to the respective colors are formed in the substrate 130. Furthermore, the substrate 130 is configured to have the ejection port arrays (first ejection port arrays) 131 corresponding to the respective ink supply ports 132. That is, the substrate 130 has the plurality of ink supply ports 132. The plurality of ink supply ports 132 extend parallel to one another in the substrate 130. Additionally, the substrate 130 has the ejection port arrays 131 each including the ejection ports arranged along the corresponding one of the plurality of ink supply ports 132 in the extending direction of the ink supply port 132.

For the optimum length of the ejection port arrays 131 in the substrate 130 in terms of costs, the ejection port arrays 131 are formed to have a length H1 smaller than the length of the ejection port arrays 121 in the substrate 120, which eject black ink, according to the present embodiment. The length H1 is set to 0.43 inches according to the present embodiment. The ejection port arrays 121 and 131 formed in the substrates 120 and 130, respectively, are arranged parallel to a conveying direction of the print medium. Furthermore, the substrate 120 is located outward of the substrate 130 along a width direction (second direction) of the print head 1 which is orthogonal to the extending direction of the ejection port arrays. When the print medium is conveyed through the ink jet printing apparatus 100, the print medium is conveyed in the conveying direction L shown in FIG. 3 with respect to the print head 1. For printing, the print head 1 ejects ink through the ejection ports while reciprocating in a scan direction M.

The ejection port arrays 121 in the substrate 120, through which black ink is ejected, and the ejection port arrays 131 in the substrate 130, through which color ink is ejected, are arranged to partly overlap within the range of an area K1 in the extending direction of the ejection port arrays (first direction). That is, as shown in FIG. 3, the ejection port arrays 121, formed in the substrate 120, and the ejection port arrays 131, formed in the substrate 130, overlap within the range of the area K1 along the extending direction of the ejection port arrays.

The ejection port arrays 121, formed in the substrate 120, and the ejection port arrays 131, formed in the substrate 130, overlap in the extending direction of the ejection port arrays and the ink supply port. According to the present embodiment, in the substrate 120, which ejects black ink, the drive circuit 124 for driving the heat generating elements is formed outside the ejection port arrays 121 in the substrate 120 along the extending direction of the ejection port arrays 121. The drive circuit 124, formed on an overlapping side of the substrate 120, is longer than a drive circuit formed opposite the overlapping side along the extending direction of the ejection port arrays in the substrate 120.

Here, the "overlapping side" refers to the side on which the ejection port arrays 121, formed in the substrate 120, and the ejection port arrays 131, formed in the substrate 130, overlap along the extending direction of the ejection port arrays. That is, the overlapping side of the substrate 120 refers to the side closer to the area K in which the ejection port arrays 121 and the ink supply port 122 overlap the ejection port arrays 131 and the ink supply ports 132 in the substrate 130. Thus, the drive circuit formed on the overlapping side of the substrate 120 is the drive circuit formed in an area C1.

According to the present embodiment, the drive circuit 124, configured to drive the heat generating elements and including a shift register, is wholly arranged within the area C1 on the overlapping side. As a result, the ejection port arrays 121 and the corresponding ink supply port 122 and drive circuit 124 in the substrate 120 partly overlap the ejection port arrays 131 and the ink supply ports 132 in the substrate 130 in the extending direction of the ejection port arrays 121. Thus, the drive circuit 124 in the substrate 120 is located in the area where the drive circuit 124 overlaps the ejection port arrays 131 and the ink supply ports 132 on the overlapping side. The ejection port arrays 121 and the ink supply port 122 in the substrate 120 are eccentrically located on the side of the substrate 120 opposite to the overlapping side of the substrate 120 where the drive circuit is not formed. That is, the ejection port arrays 121 and the ink supply port 122 are eccentrically located opposite the overlapping side within the substrate 120.

If the drive circuit 124, which is arranged in the substrate 120, for driving the heat generating elements is arranged evenly in areas B1 and C1 located on the opposite outsides of the ejection port arrays 121 in the extending direction thereof, the drive circuit opposite to the overlapping side has an increased area. Thus, a portion of the substrate 120 which projects from a corresponding end of the substrate 130 along the direction in which the ejection port arrays 121 extend has an increased length. When the portion of the substrate 120 located outward of the ejection port arrays 121 along the extending direction thereof has an increased size, the substrate 120 occupies a correspondingly increased area within the print head 1.

In contrast, in the substrate 120, the drive circuit, which drives the heat generating elements, is wholly arranged on the overlapping side, according to the present embodiment. That is, the lengths of the areas B1 and C1 located on the opposite outsides of the ejection port arrays 121 in the extending direction thereof have the following relation:

$$B1<C1.$$

Furthermore, according to the present embodiment, the drive circuit 124, formed on the substrate 120 to drive the heat generating elements, is arranged within the portion of the substrate 120 which overlaps the corresponding portion of the substrate 130 along the extending direction of the ejection port arrays. In particular, according to the present embodiment, an overlapping-side end of the substrate 120 is formed inward of an end of the substrate 130 which is opposite to the overlapping side in the extending direction of the ejection port arrays. Thus, the drive circuit 124 is arranged such that no portion of the substrate 120 projects from the end of the substrate 130 which is opposite to the overlapping side.

Furthermore, the drive circuit is arranged evenly on the opposite sides of the substrate 130, which ejects color ink, instead of being wholly formed on one side. Thus, in the substrate 130, areas F1 and G1 occupied by the drive circuit are almost equal, and the ejection port arrays 131 and the ink supply ports 132 are almost evenly arranged in the direction of the ejection port arrays (F1≅G1).

Moreover, the following relation is observed among the lengths B1, C1, F1, and G1 of the areas located on the opposite outsides of the ejection port arrays in the substrates along the extending direction L of the ejection port arrays.

$$C1/B1>G1/F1$$

That is, C1 denotes the length between the overlapping-side end of the substrate 120 and an overlapping-side end of the ink supply port 122 in the substrate 120, and B1 denotes the length between the end of the substrate 120 opposite to the overlapping-side end thereof and an end of the ink supply port 122 in the substrate 120 opposite to the overlapping-side end thereof. Furthermore, G1 denotes the length between the end of the substrate 130 opposite to the overlapping-side end thereof and an end of the ink supply port 132 in the substrate 130 opposite to the overlapping-side end thereof, and F1 denotes the length between the overlapping-side end of the substrate 130 and an overlapping-side end of the ink supply port 132 in the substrate 130. In this case, a value C1/B1 resulting from division of C1 by B1 is larger than a value G1/F1 resulting from division of G1 by F1.

This enables a reduction in a length I1 in the extending direction L of the ejection port arrays which length corresponds to a combination of the substrate 120, which ejects black ink, and the substrate 130, which ejects color ink. Thus, reducing the overall length J1 of the print head 1 enables the print head 1 to be miniaturized. Furthermore, the miniaturized print head 1 allows the manufacturing cost of the print head 1 to be restrained from increasing.

Furthermore, since the print head 1 can be miniaturized, if the print medium is conveyed by conveying rollers arranged upstream and downstream of the print head 1 in a conveying path for the print medium, the interval between the conveying rollers can be reduced. Since the interval between the conveying rollers for conveying the print medium can be reduced, the print medium can be restrained from becoming wavy between the conveying rollers. This restrains the print medium from being deformed and coming into contact with a printing surface of the print head 1. As a result, the conveying rollers can stably press the print medium.

According to the present embodiment, the substrate 130, which ejects color ink, is not configured such that the drive circuit 134 for driving the heat generating elements is eccentrically located at one end of the substrate 130. That is, the substrate 130 is not configured such that whole of the drive circuit for driving the heat generating elements is arranged in the portion of the substrate 130 which overlaps the corresponding portion of the substrate 120 as in the case of the substrate 120. The drive circuit 134 for driving the heat generating elements in the substrate 130 is evenly arranged on the opposite outsides of the ejection port arrays along the extending direction L thereof.

That is, according to the present embodiment, the drive circuit 134 in the substrate 130 is formed on the opposite outsides of the ejection port arrays 131 in the substrate 130 along the extending direction of the ejection port arrays. When the length, along the extending direction L of the ejection port arrays, of the drive circuit 134 opposite to the overlapping side of the substrate 130 is divided by the length of the overlapping-side drive circuit 134 along the extending direction L of the ejection port arrays, the result is almost 1. That is, the substrate 130 is configured such that the areas F1 and G1 formed outside the ejection port arrays along the extending direction L of the ejection port arrays have an almost equal length along the extending direction L of the ejection port arrays.

Figure 4A:
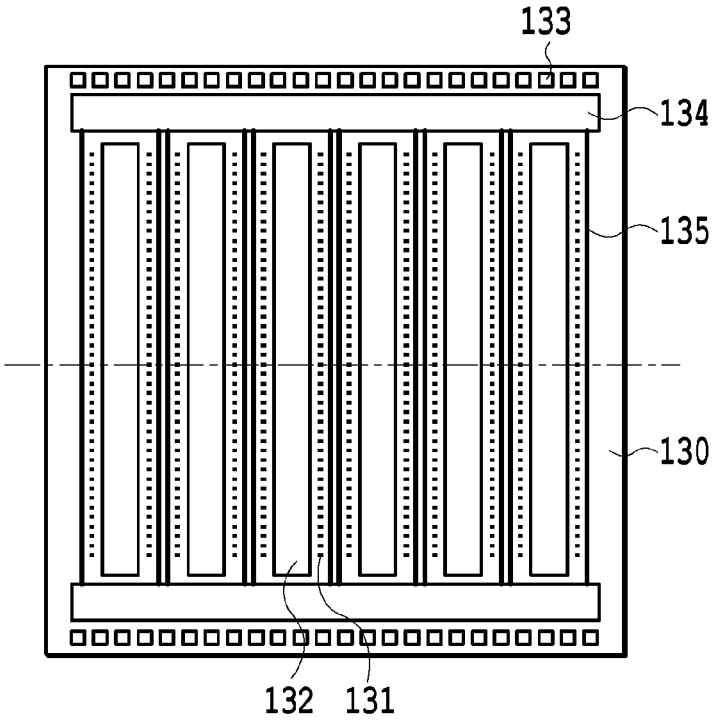
FIG. 4A is a plan view showing a substrate and wiring in FIG. 3 which are configured to eject color ink shown in FIG. 3.

FIG. 4A shows an enlarged plan view of the substrate 130 in which the drive circuit 134 is evenly arranged on the opposite outsides in the extending direction L of the ejection port arrays. If the drive circuit 134 is evenly arranged on the opposite outsides in the extending direction L of the ejection port arrays, wiring 135 connected between the drive circuit 134 and the respective heat generating elements may be connected to a maximum of half of the heat generating elements arranged in the extending direction of the ejection port arrays. Each of the heat generating elements may be connected to the drive circuit 134 located closer to the position where the heat generating element lies. Hence, each of the drive circuits 134 may be connected to the half of the ejection ports in the ejection port arrays which are positioned closer to the drive circuit 134. Thus, the print head 1 can be formed to be shorter in a direction M in FIG. 3.

Figure 4B:
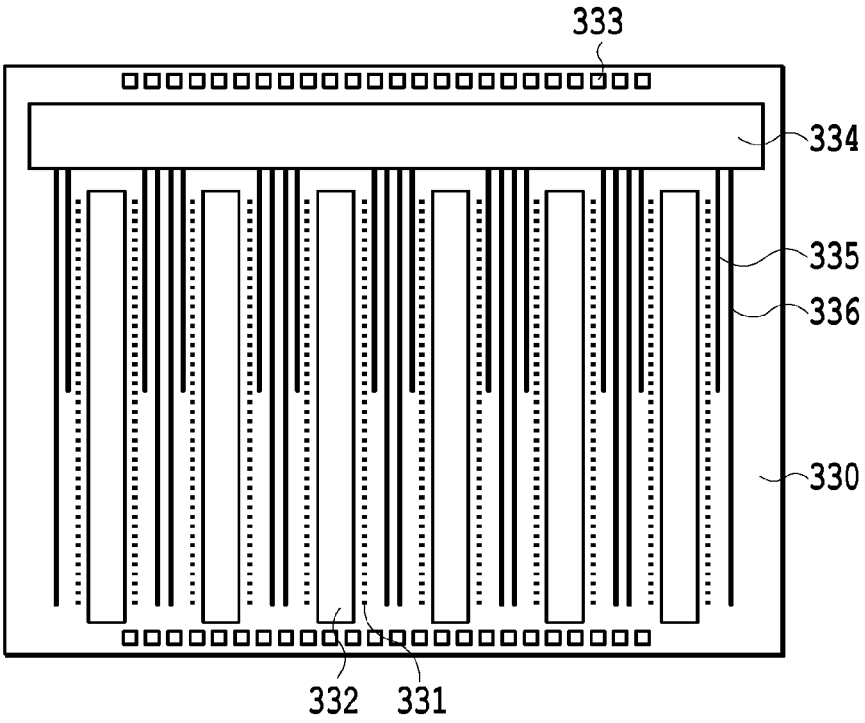
FIG. 4B is a plan view showing a comparative example of a substrate and wiring configured to eject color ink and including an eccentrically located drive circuit.

In contrast, like the substrate 120, the substrate 130 may be configured such that the drive circuit 134 is eccentrically located on the overlapping side. FIG. 4B shows an enlarged plan view of the substrate 130 in which the drive circuit 134 on the side where the substrates 120 and 130 overlap is longer than the drive circuit 134 on the side where the substrates 120 and 130 do not overlap, along the extending direction L of the ejection port arrays, as a comparative example. Arranging the drive circuit 134 in this manner enables a reduction in the area occupied by the drive circuit on the side where the substrates 120 and 130 do not overlap. Thus, as is the case with the arrangement of the drive circuit 124 in the substrate 120, the print head 1 can be formed to be shorter in the direction L.

However, if, in the substrate 130, the drive circuit for driving the heat generating elements is eccentrically located on the side where the substrates 120 and 130 overlap, the print head 1 has an increased length in the direction orthogonal to the extending direction of the ejection port arrays. That is, if the drive circuit 134 is arranged such that the drive circuit 134 in the area F1 located on the side where the substrates 120 and 130 overlap is longer than the drive circuit 134 in the area G1 located on the side where the substrate 120 and 130 do not overlap, the print head 1 has an increased length in the direction M shown in FIG. 3 due to the wiring 135.

When the drive circuit is eccentrically formed on one side, the drive circuit 334 formed on the one side needs to be electrically connected to the heat generating elements in those of the ejection ports of the ejection port arrays which are formed away from the drive circuit 334. In particular, if the drive circuit 334 is formed only on the overlapping side, the drive circuit 334 needs to be connected up to the heat generating element corresponding to the ejection port, which is located farthest from the drive circuit, of the ejection ports forming the ejection port arrays. Thus, not only the writing 335 to the close-located heat generating elements but also wiring 336 to the far-located heat generating elements is connected to the drive circuit 334.

In this case, an increased amount of wiring is connected to the drive circuit 334 eccentrically located on one side, correspondingly increasing the size of a space around the drive circuit 334 which is required for the wiring. Thus, as shown in FIG. 4B, the print head 1 has an increased length in the direction M shown in FIG. 3. This may increase the size of the substrate 130. Furthermore, the electric connection between the drive circuit 334 and heat generating elements positioned far from the drive circuit 334 requires the increased distance of the wiring between the drive circuit 334 and the heat generating elements. Thus, when the difference in wiring resistance between heat generating elements positioned close to the drive circuit 334 and heat generating elements positioned far from the drive circuit 334 is taken into account, the wiring needs to be formed to be wider for the far-positioned heat generating elements. Hence, the space for the wiring needs to be enlarged in the direction M orthogonal to the extending direction of the ejection port arrays. This may correspondingly increase the substrate 130 in size in the direction M. The increased size of the substrate 130 may increase the print head 1 in size. The increased size of the print head 1 may increase the manufacturing cost of the print head 1.

Furthermore, the substrate 130 includes the plural types of ejection port arrays corresponding to the types of ink in order to allow color ink to be ejected. Thus, if the drive circuit 334 is eccentrically located on one side for all the ejection port arrays formed in the substrate 130, the length in the direction M further increases by an amount equivalent to the number of ejection ports. This may further increase the substrate 130 in size. The increased size of the substrate 130 may further increase the print head 1 in size. In the substrate 120 for ejecting black ink, the ejection port arrays 121 correspond only to the ink in one color, and thus the print head 1 is not substantially increased in size in the direction M even if the drive circuit 124 is eccentrically located on one side. Hence, the print head 1 can be shortened in the direction L, while being restrained from increasing in size in the direction M. Consequently, the present embodiment adopts, for the substrate 120, the form in which the drive circuit 124 is eccentrically located on one side. However, if the drive circuit is eccentrically located in the substrate 130, in which the plurality of ejection port arrays are formed, the size of the print head 1 increases by a non-negligibly large amount in the direction M. Thus, the present embodiment preferably avoids adopting the form in which the drive circuit 134 is eccentrically located on one side, for the substrate 130 with the plurality of ejection port arrays arranged therein.

Therefore, according to the present embodiment, the print head 1 is configured such that the drive circuit 134 is arranged evenly on the opposite outsides of the ejection port arrays along the extending direction L of the ejection port arrays as shown in FIG. 4A, instead of being eccentrically located on the overlapping side as shown in FIG. 4B. Thus, the print head 1 can be restrained from increasing in size in the direction M. Furthermore, the manufacturing cost of the print head 1 can be restrained from increasing.

According to the present embodiment, in the substrate 130, the drive circuit for driving the heat generating elements is arranged evenly on the opposite outsides of the ejection port arrays along the extending direction L of the ejection port arrays. However, the present invention is not limited to this. If, in the substrate 130, a reduction in the length of the substrate 130 in the extending direction L of the ejection port arrays associated with the eccentric arrangement of the drive circuit on one side is given priority over an increase in the length of the substrate 130 in the direction M, which is orthogonal to the direction L, the drive circuit may be eccentrically located on one side. That is, the drive circuits 134 may be formed such that the drive circuit 134 located in the area F1 is longer than the drive circuit 134 located in the area G1. Then, the portion of the substrate 130 which projects from the corresponding end of the ejection port arrays in the direction L caused by the drive circuit 134 may also be located in the portion of the substrate 130 which overlaps the corresponding portion of the substrate 120. Thus, on the side where the substrate 120 and 130 do not overlap, the portion of the substrate 130 which projects outward from the corresponding end of the ejection port arrays in the direction L can be restrained from increasing in size. This increases the length of the substrate 130 in the direction M orthogonal to the extending direction L of the ejection port arrays but enables a reduction in the length of the substrate 130 in the extending direction L of the ejection port arrays. As a result, the area G1 in the print head 1 can be reduced in length to further decrease the area I1 in length. The print head 1 can further be miniaturized in the direction L.

According to the present embodiment, at least in the substrate 120, which ejects the black ink, the length of the drive circuit on the overlapping side where the substrates 120 and 130 overlaps along the extending direction of the ejection port arrays is larger than the length of the drive circuit on the side opposite to the overlapping side. Thus, the length of the print head 1 along the extending direction of the ejection port arrays can be reduced. This enables the print head 1 to be miniaturized and allows the manufacturing cost of the print head 1 to be restrained from increasing. Furthermore, if the conveying rollers are installed upstream and downstream of the print head 1 along the conveying path for the print medium, the interval between the conveying rollers can be reduced. This enables the print medium to be reliably inhibited from floating and allows the quality of print images to be prevented from being degraded as a result of contact of the print medium with the print head. Additionally, the print medium can be restrained from becoming wavy, thus preventing the distance between the print head 1 and the print medium from varying. Consequently, pint images can be restrained from being subjected to color banding.

Second Embodiment

Now, a print head 200 according to a second embodiment of the present invention will be described. Components of the print head 200 which can be configured as is the case with the first embodiment are denoted in the figures by the same reference numerals as those in the first embodiment and will not be described below. Only differences from the first embodiment will be described.

Figure 5:
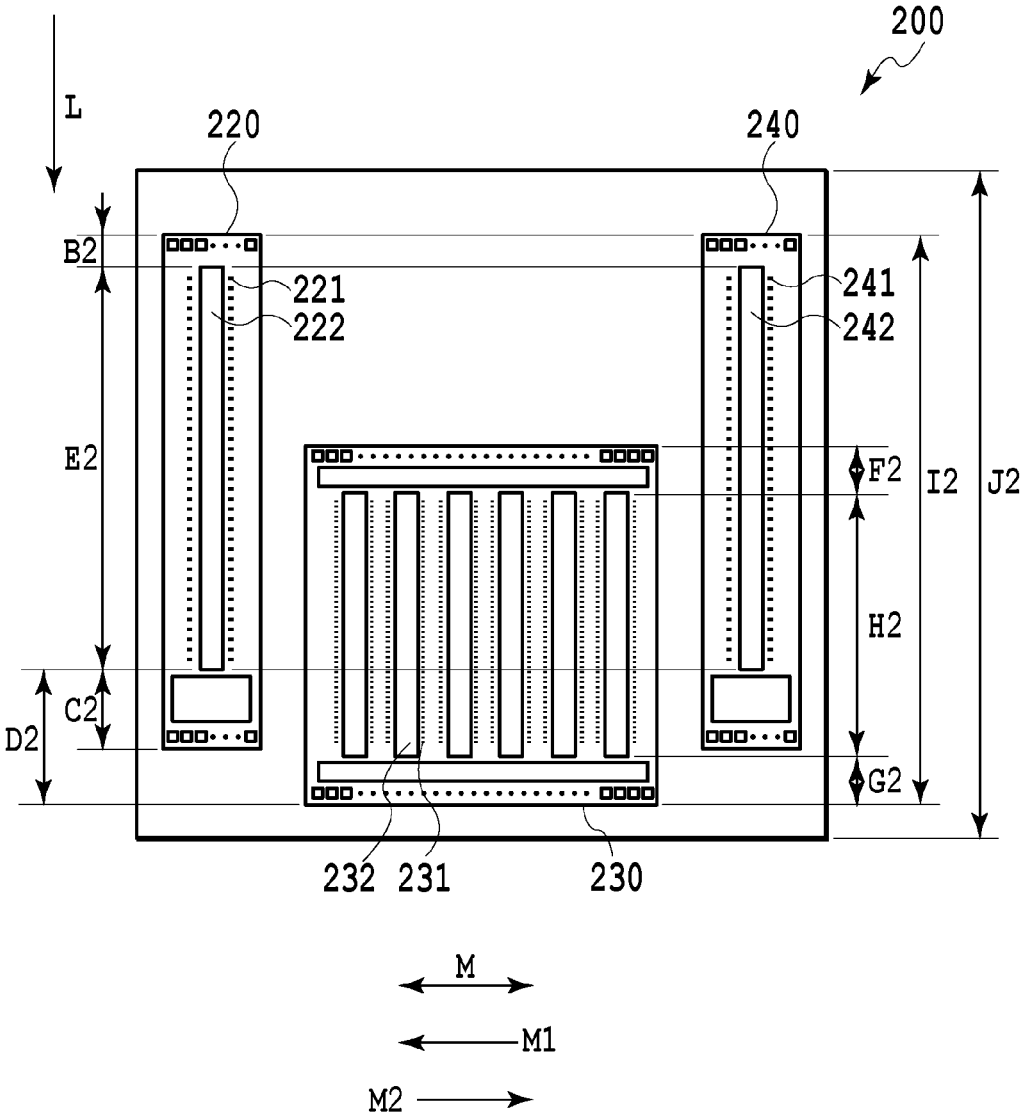
FIG. 5 is a plan view showing a surface of a print head according to a second embodiment of the present invention on which substrates are arranged.

FIG. 5 shows a plan view of a surface of the print head 200 according to the second embodiment of the present invention on which substrates 120 and 130, as viewed from a print medium side. According to the first embodiment, one substrate 120 that ejects black ink and one substrate 130 that ejects color ink are mounted on a support 160 to form a print head. In contrast, the print head 200 according to the second embodiment has two substrates 220 and 240 which eject black ink. In the print head 200, the two substrates 220 and 240 are arranged on the opposite outsides of a substrate 230 that ejects color ink, along a direction orthogonal to the extending direction of ejection port arrays in such a manner that the substrate 230 is sandwiched between the substrates 220 and 240.

The print head according to the present embodiment includes more substrates (substrates 220 and 240) for ejecting black ink than the print head according to the first embodiment. Thus, when the print head is set such that a portion of the print medium to be printed with black ink is to be printed by both the substrates 220 and 240, the print speed can further be increased at which print images such as characters which are printed with black ink are printed.

Furthermore, according to the present embodiment, the two substrates 220 and 240, which eject black ink, are arranged symmetrically with respect to the substrate 230, which ejects color ink. Since the substrates 220 and 240 are thus arranged symmetrically with respect to the substrate 230, when the print head carries out scanning in a reciprocatory manner, the order in which the substrates used for ink ejection passes through a print area can be maintained constant both during forward movement and backward movement.

For example, the substrates used for ink ejection are set such that only the substrates 220 and 230 are used when the print head 200 carries out scanning in a direction M1 and that only the substrates 240 and 230 are used when the print head 200 carries out scanning in a direction M2. At this time, when the print head 200 moves in the direction M1 shown in FIG. 5, first, the substrate 220, which ejects black ink, passes over the print area of a print medium, and then the substrate 230, which ejects color ink, passes over the print area. Furthermore, when the print head 200 moves in the direction M2 shown in FIG. 5, first, the substrate 240, which ejects black ink, passes over the print area of the print medium, and then the substrate 230, which ejects color ink, passes over the print area. When the substrates used for ink ejection are set as described above, the order of ink ejection during the formation of print images is constant so that the ejection of black ink is followed by the ejection of color ink.

Thus, during printing, the order in which the substrates 220 and 240, which eject black ink, and the substrate 230, which ejects color ink, pass through the print area is constant. This suppresses a possible difference in print image between the forward movement and the backward movement. Furthermore, with the quality of print images restrained from being degraded, printing can be carried out both during forward scan and during backward scan. Therefore, print throughput can be increased, and printing can be efficiently achieved.

The order is not limited to the above-described order. The ejection of color ink may be followed by the ejection of black ink.

Furthermore, to make the order in which black ink and color ink are ejected constant both during the forward scan and during the backward scan, the substrate 230, which ejects color ink, is preferably configured such that ejection port arrays through which the respective color inks are ejected are arranged symmetrically.

Third Embodiment

Now, a print head according to a third embodiment of the present invention will be described. Components of this print head which can be configured as is the case with the first embodiment and the second embodiment are denoted in the figures by the same reference numerals as those in the first embodiment and the second embodiment and will not be described below. Only differences from the first embodiment and the second embodiment will be described.

The first embodiment and the second embodiment have been described in conjunction with the print head in which the substrate for ejecting black ink and the substrate for ejecting color ink are mounted on the same support and in which the respective substrates are attached to the same print head. In contrast, the third embodiment will be described in conjunction with a print head in which a substrate for ejecting black ink and a substrate for ejecting color ink are mounted on different print heads.

Figure 6A:
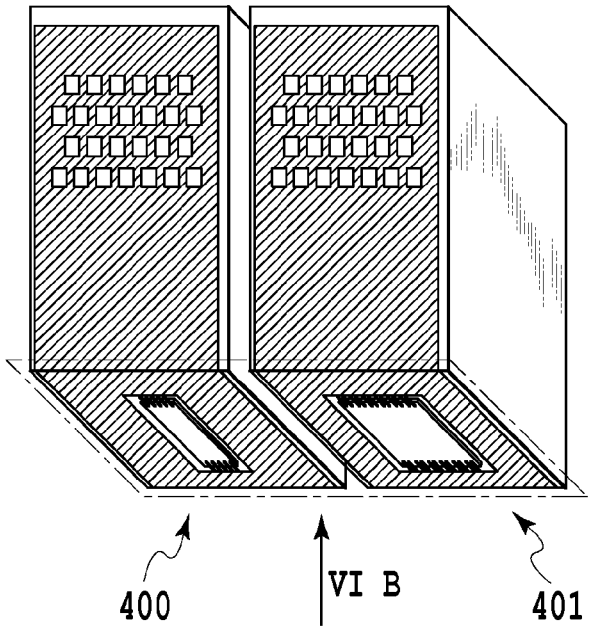
FIG. 6A is a perspective view of print heads according to a third embodiment of the present invention.
Figure 6B:
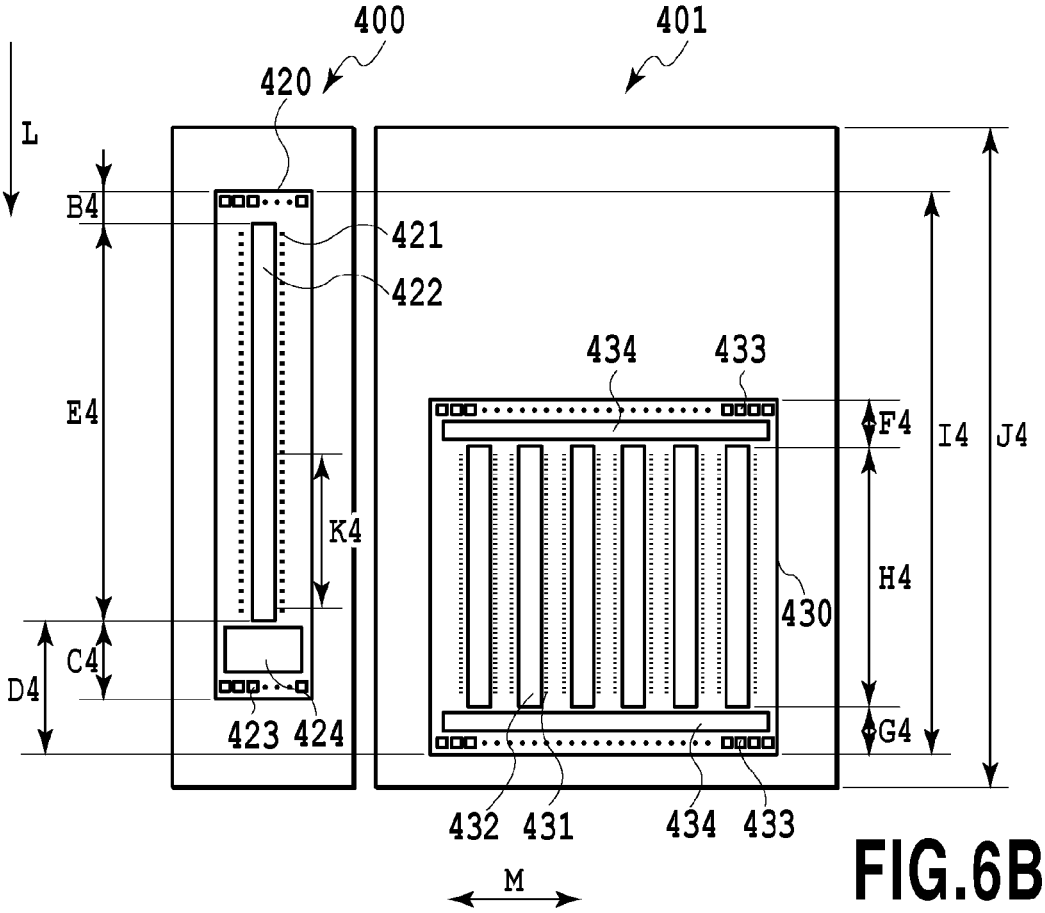
FIG. 6B is a plan view showing a surface of each of the print heads on which substrates are arranged.

FIG. 6A shows a perspective view of the print head according to the third embodiment. FIG. 6B shows a plan view of the print head shown in FIG. 6A as viewed along arrow VIB.

A substrate 430 (first substrate) is mounted on a print head 401 (first print head). The substrate 430 includes a plurality of ink supply ports 432 formed therein and extending parallel to one another and ejection port arrays (first ejection port arrays) 431 also formed therein and including ejection ports arranged along the respective plurality of ink supply ports 432 in the extending direction of the ink supply ports 432. The substrate 430 ejects color ink. According to the present embodiment, the substrate 430 is formed such that the ejection port arrays in the substrate 430 are 0.43 inches in length.

A substrate 420 (second substrate) is mounted on a print head 400 (second print head). The substrate 420 includes ink supply ports 422 formed therein and extending parallel to the extending direction of ejection ports; the ink supply port 422 is longer than the ink supply port 432, and the number of the ink supply ports 422 is smaller than the number of the ink supply ports 432. According to the present embodiment, only one ink supply port 422 is mounted on the print head 400. Furthermore, in the substrate 420, ejection ports are arranged along the ink supply port 422, and ejection port arrays (second ejection port arrays) 421 are formed which are longer than the ejection port arrays 431. The substrate 420 ejects black ink. According to the present embodiment, in order to print characters faster, the substrate 420, which ejects black ink, is formed such that the ejection port arrays 421 has a length E4 of 0.85 inches.

According to the present embodiment, the ejection port arrays 431, formed in the substrate 430, overlap the ejection port arrays 421, formed in the substrate 420, within the range of an area K4 along the extending direction of the ejection port arrays, as shown in FIG. 6B.

During printing, the print heads 400 and 401 carry out the same scanning. During printing, the print heads carry out scanning along the direction of along M shown in FIG. 6B.

As described above, the substrate that ejects black ink and the substrate that ejects color ink may be mounted on the different print heads.

The present embodiment has been described in conjunction with the configuration in which the substrate that ejects black ink and the substrate that ejects color ink may be mounted on the different print heads. However, the present invention is not limited to this configuration. An integrated print head may be used which includes a print head with a black-ink-ejecting substrate mounted thereon, a print head with a color-ink-ejecting substrate mounted thereon, a contact substrate 10, and a wiring member 30 which are all integrated together, with only supports formed separately from each other. That is, the print heads are configured as an integrated print head that uses the common contact substrate 10 and the common wiring member 30, and the supports on which the respective substrates are mounted are separate members. In this case, the print heads are integrated together. The supports include a support on which the substrate 430 is mounted to support the substrate 430 (first support) and a support on which the substrate 420 is mounted to support the substrate 420 (second support). The support with the substrate 430 mounted thereon is arranged separately from the support with the substrate 420 mounted thereon. As described above, the print heads may be integrated together, and the support with the black-ink-ejecting substrate mounted thereon and the support with the color-ink-ejecting substrate mounted thereon may be exclusively configured separately.

In the specification, the term "printing" is not only used to form meaningful information such as characters and figures but also used regardless of whether the information is meaningful or meaningless. The term "printing" also widely represents formation of an image or a pattern on a print medium or processing of the print medium regardless of whether the printing is carried out so that a human being can visually perceive the result of the printing.

Furthermore, examples of the "printing apparatus" include apparatuses such as a printer, a printer complex machine, a copier, and a facsimile machine which have a print function, as well as manufacturing apparatuses that manufacture articles using an ink jet technique.

Additionally, the term "print medium" not only refers to paper used for general printing apparatuses but also widely represents articles such as a cloth, a plastic film, a metal plate, glass, ceramics, wood, and leather which can receive ink.

Moreover, the term "ink" (also sometimes referred to as the "liquid") should be broadly interpreted as is the case with the definition of the "printing". The term "ink" is intended to represent a liquid that can be applied onto a print medium to form an image or a pattern or to process the print medium or to process the ink (for example, to coagulate or insolubilize a coloring material in the ink applied to the print medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-101330, filed Apr. 26, 2012, which is hereby incorporated by reference herein in its entirety.

What is claimed is:

1. A print head which is mountable in an ink jet printing apparatus and which ejects ink for printing, the print head comprising:

a substrate comprising a plurality of ejection ports through which ink is ejected, print elements arranged in ink channels that are in communication with the respective ejection ports, each of the print elements being driven to apply kinetic energy to the ink in the corresponding ink channel to eject the ink through the corresponding ejection port, a drive circuit for driving the print elements, and an ink supply port that supplies ink to the ink channels, and a support that supports the substrate, wherein the substrate includes:

a first substrate comprising a plurality of first ink supply ports formed therein and extending parallel to one another and first ejection port arrays formed therein and each first ejection port array comprising the ejection ports arranged along one of the plurality of first ink supply ports in a first direction in which the one first ink supply port extends; and a second substrate comprising a second ink supply port formed therein and extending parallel to the first direction and arranged outward of the first substrate along a second direction orthogonal to the first direction, the second ink supply port being longer than the first ink supply ports, a number of the second ink supply ports being smaller than a number of the first ink supply ports, and second ejection port arrays formed in the second substrate and comprising the ejection ports arranged in the first direction along the second ink supply port, the second ejection port arrays being formed to be longer than the first ejection port arrays along the first direction, the drive circuit formed in the second substrate is formed outside the second ejection port arrays in the second substrate along the first direction, and the drive circuit formed on an overlapping side of the second substrate where the first ejection port arrays and the second ejection port arrays overlap is formed to be longer, along the first direction, than the drive circuit formed on a side of the second substrate opposite to the overlapping side, and the first ejection port arrays and the second ejection port arrays overlap in an extending direction of the first ink supply ports and the second ink supply port, and the first substrate and the second substrate are mounted on the support, wherein a value resulting from division of a length between an overlapping side end of the second substrate and an overlapping side end of the second ink supply port by a length between an end of the second substrate which is opposite to the overlapping side and an end of the second ink supply port which is opposite to the overlapping side is larger than a value resulting from division of a length between an end of the first substrate which is opposite to the overlapping side and an end of the first ink supply port which is opposite to the overlapping side by a length between an overlapping side end of the first substrate and an overlapping side end of the first ink supply port.

2. The print head according to claim 1, wherein the drive circuit formed in the second substrate is arranged so as to lie within a portion of the second substrate which overlaps a corresponding portion of the first substrate along the first direction.

3. The print head according to claim 1, wherein the support includes a first support on which the first substrate is mounted to support the first substrate and a second support on which the second substrate is mounted to support the second substrate, and the first support and the second support are arranged separately from each other.

4. The print head according to claim 1, wherein, in the first substrate, the ejection ports are arranged on opposite sides of each of the plurality of first ink supply ports along the first ink supply ports, and the first ejection port arrays are formed to sandwich the first ink supply ports between the first ejection port arrays, and in the second substrate, the ejection ports are arranged on opposite sides of the second ink supply port along the second ink supply port, and the second ejection port arrays are formed to sandwich the second ink supply port between the second ejection port arrays.

5. The print head according to claim 1, wherein the drive circuit formed in the first substrate is formed on opposite outsides of the first ejection port arrays in the first substrate along the first direction, and a value resulting from division of a length, along the first direction, of the drive circuit on a side of the first substrate which is opposite to the overlapping side by a length of the drive circuit on the overlapping side along the first direction is almost 1.

6. The print head according to claim 1, wherein an overlapping side end of the second substrate is formed inward of an overlapping side end of the first substrate in the first direction.

7. The print head according to claim 1, wherein the single second ink supply port is formed in the second substrate.

8. The print head according to claim 1, wherein two second substrates are provided, and the two second substrates are arranged on opposite outsides of the first substrate along the second direction to sandwich the first substrate between the second substrates.

9. A print head which is mountable in an ink jet printing apparatus and which ejects ink for printing, the print head comprising:

a first substrate comprising a plurality of first ink supply ports formed therein and extending parallel to one another, each of the first ink supply ports extending along the first direction; and a second substrate comprising a second ink supply port formed therein and extending parallel to the first direction and arranged outward of the first substrate along a second direction orthogonal to the first direction, the second ink supply port being longer than the first ink supply ports, a number of the second ink supply ports being smaller than a number of the first ink supply ports, wherein the first ink supply ports and the second ink supply port overlap with respect to the first direction, and a drive circuit for driving print elements is formed at least between an overlapping side end of the second substrate and an overlapping side end of the second ink supply port, and wherein a value resulting from division of a length between the overlapping side end of the second substrate and the overlapping side end of the second ink supply port by a length between an end of the second substrate which is opposite to the overlapping side and an end of the second ink supply port which is opposite to the overlapping side is larger than a value resulting from division of a length between an end of the first substrate which is opposite to the overlapping side and an end of the first ink supply port which is opposite to the overlapping side by a length between an overlapping side end of the first substrate and an overlapping side end of the first ink supply port.

* * * * *